United States Patent [19]

Southard

[11] 4,150,599

[45] Apr. 24, 1979

[54] DIGITAL KEYING SYSTEM FOR AN ELECTRONIC MUSICAL INSTRUMENT

[75] Inventor: James S. Southard, Union, Mich.

[73] Assignee: C. G. Conn, Ltd., Oak Brook, Ill.

[21] Appl. No.: 821,734

[22] Filed: Aug. 4, 1977

[51] Int. Cl.[2] ..... G10H 1/00

[52] U.S. Cl. ..... 84/1.03; 84/1.13

[58] Field of Search ..... 84/1.01, 1.09, 1.13, 84/1.26, 1.27, 1.03, DIG. 12, DIG. 22

[56] References Cited

U.S. PATENT DOCUMENTS

| | | | |
|---|---|---|---|
| 3,908,504 | 9/1975 | Deutsch | 84/1.19 |
| 3,977,291 | 8/1976 | Southard | 84/1.13 |
| 4,072,078 | 2/1978 | Schallensberger et al. | 84/1.03 |

*Primary Examiner*—James R. Scott

*Assistant Examiner*—Jit W. Miska

*Attorney, Agent, or Firm*—Kenyon & Kenyon, Reilly, Carr & Chapin

[57] ABSTRACT

A digital keying system for an electronic musical instrument, such as an electronic organ, comprises a digital percussion generator which synchronizes the operation of a variable attentuator with the zero crossings of a sine wave signal applied to the input of the attenuator from a waveform generator. Pulses from a rhythm generator are applied to a coincidence gating circuit along with pulses corresponding the zero crossings of the sine wave signal from the waveform generator to synchronize the stepped operation of the variable attenuator with the zero crossings of the sine wave signal applied to it.

9 Claims, 1 Drawing Figure

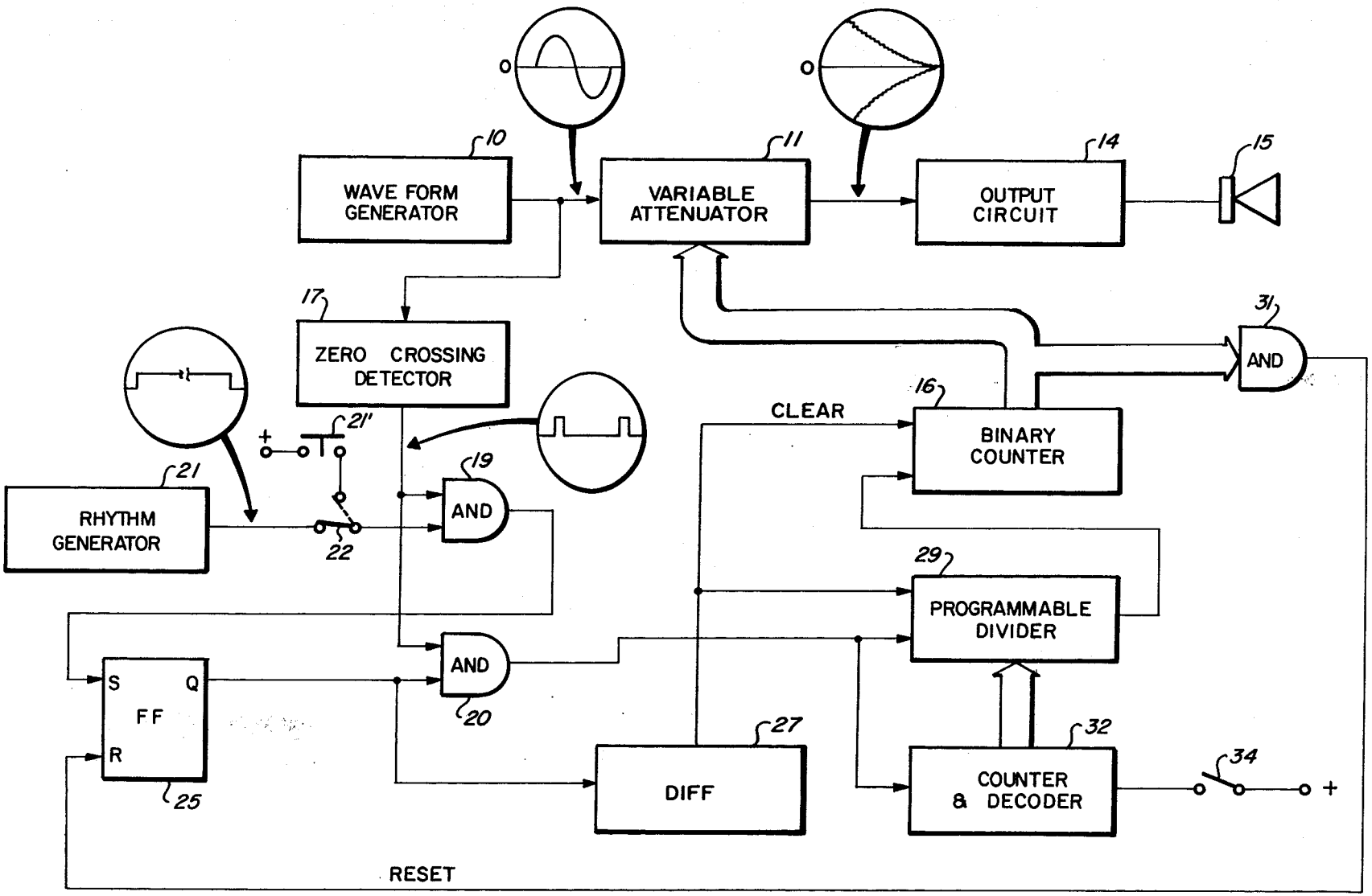
WAVE FORM GENERATOR
10
VARIABLE ATTENUATOR
11
OUTPUT CIRCUIT
14
15
ZERO CROSSING DETECTOR
17
BINARY COUNTER
16
AND
31
CLEAR
AND
19
AND
20
RHYTHM GENERATOR
21
21'
22
PROGRAMMABLE DIVIDER
29
COUNTER & DECODER
32
34
DIFF
27
FF
25
S
R
Q
RESET

DIGITAL KEYING SYSTEM FOR AN ELECTRONIC MUSICAL INSTRUMENT

RELATED APPLICATION

The subject matter of this application is related to the digital keying system disclosed in U.S. Pat. No. 3,977,291, issued Aug. 31, 1976.

BACKGROUND OF THE INVENTION

In modern electronic organs and other electronic tone producing devices of the key actuated type, it has been the practice to employ circuit arrangements for modifying the decay times of tones upon release of a key. This is done to produce percussion effects or to produce natural sounding tonal effects representative of other instruments. Percussion keyers are becoming increasingly popular in conjunction with electronic organs which include circuitry for automatically or semi-automatically producing a percussion accompaniment to the playing of melody and chords on the manuals of the organ. The percussion accompaniment generally is controlled by a rhythm generator system which can be switched into and out of operation at the will of the musician playing the organ. Different rhythm patterns for producing different types of percussive effects are employed.

In the past, it has been common to utilize resistive-capacitive (RC) networks for establishing the desired time delays to create the tone amplitude decay rate used to create percussion effects. The capacitors in such timing circuits have relatively large values of capacitance, and it has been necessary to use large numbers of such RC circuits corresponding to the number of keyers used in the instrument. Variations in tolerances of such capacitors make it difficult to consistently reproduce the same effects from one instrument to another. Similar difficulty also is encountered within the same instrument in obtaining uniform decay characteristics among the various keys used in the instrument when RC delay circuits are used.

Another disadvantage of the use of RC timing circuits in electroinc musical instruments is that, at the present state of the art, it is not economically feasible to form large capacitors as part of integrated circuits. Thus, as integrated circuitry is used for other portions of the logic function of an electronic instrument, it still is necessary to employ discrete capacitors. This requires additional bonding pads on the integrated circuit chips, reducing the useable chip area, and also increases manufacturing costs because of the hybrid nature of the circuitry.

The above identified U.S. Pat. No. 3,977,291 discloses an attenuator network which may be used to produce percussion effects or other time delays in the attack and decay of a keyer used in conjunction with an attenuator which does not employ RC timing circuits. Instead, a switching network controlled by a counter is used to vary the attenuation of the tone signals applied to the attenuator network according to a predetermined set pattern. Such a keyer-attenuator network is ideally suited for use in a percussion system in conjunction with a rhythm generator to produce the desired percussion sounds or tones. A disadvantage, however, exists in the use of this circuit as a percussion keyer inasmuch as it is possible to switch on the attenuator (representative of the inception of a tone) at any time during the cycle of an applied sine wave signal to the input of the attenuator. If the attenuator/keyer network is turned on when the input tone signal has a maximum amplitude (as is the case for percussion sounds), very unpleasant sound effects are produced at the start of the tone. Such tone effects are unnatural and tend to detract from the overall musical quality of any selection which is being played when such an effect is produced. Since the oscillators of the tone keyers are free running and the attenuators may be switched to pass tones from the tone oscillators to their outputs at any random time in the cycle of the tone waveform, even the unpleasant tone effects are not consistent. Therefore, it is difficult to take countermeasures to effectively eliminate these effects. Such effects are most noticeable in conjunction with digital percussion keyers since the attack of such tones is practically instantaneous to maximum tone output (minimum attenuation) with a repidly decaying amplitude after the initial attack.

Therefore, it is desirable to provide a digital keyer, and particularly a digital percussion keyer, which has a realistic sound and which consistently switches the keyer on and varies the tone attenuation at the zero crossings of the sine wave signals produced by the tone generator used to supply input signals to the attenuator.

SUMMARY OF THE INVENTION

Accordingly, it is an object of this invention to provide an improved keyer for an electronic musical instrument.

It is another object of this invention to provide an improved percussion keyer for an electronic musical instrument.

It is another object of this invention to provide an improved digital percussion keyer for an electronic musical instrument.

It is a further object of this invention to provide an improved digital percussion keyer which always switches on the reproduced tone at a zero crossing of the input signal waveform.

It is a further more specific object of this invention to derive the control signals for a digital percussion keyer from the input waveform of the signal applied to the input of a variable attenuator used in such a keyer.

In accordance with a preferred embodiment of this invention, a keyer for use in an electronic musical instrument includes a source of alternating current tone signals which are applied to the input terminal of a variable attenuator circuit. The attenuator circuit has an output terminal and at least one control terminal coupled to it. A source of rhythm pattern pulses which are of relatively long duration compared to the frequency of the zero crossings of the tone signals, is connected to a coincidence circuit along with signals produced by the source of tone signals. The coincidence circuit produces a sequence of pulses which are coincident with the zero crossings of the alternating current tone signals whenever rhythm pulses are supplied simultaneously by the source of rhythm pulses. The output of the coincidence circuit then is coupled to a further circuit connected to the control terminal of the variable attenuator circuit for controlling its operation in response to and in synchronism with the sequence of pulses produced by the coincidence circuit.

BRIEF DESCRIPTION OF THE DRAWING

The sole FIGURE of the drawing is a block diagram of a preferred embodiment of the invention.

DETAILED DESCRIPTION

Referring now to the drawing, there is shown a tone waveform generator 10 which produces sine wave signals applied to the input of a variable attenuator network 11 used to shape the attack, sustain, and decay characteristics of the tones applied to its input. The attenuator network 11 supplies output tone signals to a conventional electronic organ output circuit 14 which includes the conventional voicing and amplifier circuits. This circuit 14 then supplies the tone signals to an output loudspeaker 15 for audible reproduction.

The variable attenuator 11 preferrably is a digital attenuator of the type disclosed in the aforementioned patent 3,977,291. This attenuator has its attenuation characteristics varied under control of a binary counter 16 in the same manner as the attenuator of the U.S. Pat. No. 3,977,291. Reference should be made to that patent for a disclosure of the operation of the variable attenuator network, and the disclosure of the U.S. Pat. No. 3,977,291 is incorporated herein by reference. The binary counter 16, however, for use in a digital percussion keyer of the type disclosed in the drawings need not be a reversible counter, since digital percussion sound effects essentially are switched on at full amplitude; and the attenuator 11 then merely is used to produce the desired decay characteristics of the tone representative of the particular percussion effect which is to be produced by the circuit.

In an electronic organ, several percussion keyers of the type shown in the drawing are used, one for each of the different percussion effects which is to be produced by the system. For example, the keyer shown in FIG. 1 may be used in conjunction with a waveform generator 10 producing a tone signal of the proper frequency to develop a snare drum sound effect. Different frequencies are used for bass drums, bongo drums, bells, etc. The different frequencies which are used in each of the different percussion keyer circuits may be produced from a single clock circuit; but for any particular keyer, the frequency of the signal produced by the waveform generator 10 is unique for that keyer; and a different keyer is used for each of the different sound effects. The generator 10 may be either an analog or a digital waveform generator of a known type.

To control the switching on of the variable attenuator 11 and the switching of each of the digital steps in its decay waveform characteristic in synchronism with the zero crossings of the sine wave produced by the waveform generator 10, a zero crossing detector circuit 17 is also connected to the output of the waveform generator 10 to receive the same signals which are applied to the input terminal of the variable attenuator 11. The zero crossing detector 17 may be of any conventional type and produces a sequence of narrow positive pulses at its output each time the sine wave tone signal crosses the zero axis (or reverses direction). These output pulses are applied to one of two inputs of each of a pair of AND gates 19 and 20. The other input of the AND gate 19 constitutes a series of pulses applied through a switch 22 from a rhythm pattern generator 21 of the type commonly employed in electronic organs today to produce automatic or semiautomatic rhythm accompaniment patterns. The pulses produced by the rhythm generator 21 each have a very long pulse duration relative to the frequency of the pulses representative of the zero crossings produced at the output of the zero crossing detector 17. This is represented by showing the output of the rhythm generator 21 as a long pulse which has been broken in the middle. Alternatively, the rhythm pulses can be manually produced by a pushbutton switch 21 when the switch 22 is in its upper (dotted line) position.

Whenever a pulse is present at the output of the rhythm generator 21 at the same time a zero crossing pulse is produced by the output of the zero crossing detector 17, the AND gate 19 produces an output pulse. These output pulses are applied to the "set" input of a "set/reset" flip-flop 25, which previously has been placed in its "reset" stable state of operation (as is described subsequently). Thus, assume that the system has just been turned on and the first rhythm pulse is obtained from the rhythm generator 21 for initiating the percussion sound effect desired from the variable attenuator 11. At this point, just prior to system operation, the variable attenuator 11 also is in its maximum attenuation state; and no output signals are applied to the output circuit 14.

When coincidence of pulses from the outputs of the zero crossing detector 17 and the rhythm generator 21 is first detected by the AND gate 19, a pulse is passed by the gate 19 to trigger the flip-flop 25 to its "set" state of operation, causing its "Q" output to go "high" from its previous "low" state. This enables the AND gate 20, and the "low-to-high" transition also is applied through a differentiating circuit 27 to produce a reset pulse to reset or clear the binary counter 16 to an initial or zero count and also to clear another counter 29 used as a programmable frequency divider to its initial state of operation.

At the time the binary counter 16 is cleared, the parallel outputs from this counter connected to the control inputs of the variable attenuator 11 cause the attenuator to be placed in its minimum attenuation state, thereby permitting signals of maximum applitude to appear on its output. This is done at a zero crossing of the input sine wave signal applied to the variable attenuator 11, since the reset operation of the counter 16 is in synchronism with the zero crossing pulses produced by the zero crossing detector 17. The width of the pulses from the rhythm generator 21 is sufficient to ensure that at least one pulse from the detector 17 will occur during each rhythm pulse duration. Thus, "setting" of the flip-flop 25 is assured.

Each of the subsequent pulses appearing on the output of the zero crossing detector 17 are passed by the AND gate 20, which remains enabled by the flip-flop 25 irrespective of the presence of a rhythm pulse, to the programmable divider 29. The output pulses from the divider 29 are used as the input pulses for stepping the binary counter 16 through the count pattern which produces the stepped attenuation of the digital variable attenuator 11. This operation is the same as described in U.S. Pat. No. 3,977,291, so that it is not described in detail here. The binary counter 16 is stepped through its count cycle until a maximum count is reached. This maximum count is the one which causes the variable attenuator circuit to have maximum attenuation (that is, to be turned off), and this same count is detected by a multiple input AND gate 31 to produce a reset pulse to the flip-flop 25. When this pulse occurs, the flip-flop 25 is set to have a "low" potential on its "Q" output; and the AND gate 20 is disabled. No further pulses are passed by the AND gate 20 and the system awaits the application of the next output pulse from the rhythm generator 21.

Whenever the next output pulse from the rhythm generator 21 occurs, the above cycle of operation is repeated. The particular tone effect produced by the circuit depends upon the frequency of the signals generated by the waveform generator 10, and differnet tone effects are produced in response to different frequencies. In addition, the tone effect is altered by the attenuation rate produced by the variable attenuator 11, and this in turn is controlled by the operation of the binary counter 16 and the frequency of the pulses applied to that counter from the output of the programmable frequency divider 29. For a system where the circuit is dedicated to produce the same specific percussion sound at all times, the programmable frequency divider 29 can be replaced with a fixed frequency divider, the division ratio of which is chosen to be in accordance with the desired sound effect.

When, however, the system is used to produce the percussion sounds of a piano and other kinds of struck instruments, it is necessary to change the "Q" of the attenuation rate prior to full decay in order to reproduce the most realistic simulation of the instrument. When this type of effect is desired, an additional counter and decoder circuit 32 may be used. The counter and decoder circuit 32 has several parallel outputs which are connected to the different stages of the programmable divider 29 for changing the count in the programmable divider 29 in accordance with a preestablished output of the circuit 32. The pulses obtained from the output of the AND gate 20 also are applied to the input of the counter circuit 32, which normally is not enabled for operation unless the circuit shown in the drawing is used to produce piano sounds or the like. If this latter situation is the case, a switch 34 is closed to enable the counter and decoder circuit 32. After a preestablished number of pulses from the AND gate 20 are counted by the circuit 32, a parallel pattern of outputs is obtained from it to change the division ratio of the programmable divider 29. This in turn changes the frequency of the pulses applied to the input of the binary counter 16 to change the rate at which the variable attenuator 11 is stepped. Thus, the "Q" of the decay of the output signal waveform from the attenuator 11 is altered as desired.

The foregoing description of a preferred embodiment of the invention is intended to be illustrative only of the invention, and various equivalent variations will occur to those skilled in the art.

I claim:

1. A keying system for an electronic musical instrument including in combination:

a source of alternating current tone signals of a predetermined frequency;

variable attenuator means having an input coupled to said source of tone signals, a signal output terminal, and at least one control terminal;

a source of pulses, each said pulse representing the desired production of a sound corresponding to said tone signals;

coincidence circuit means coupled to said source of pulses and to said source of tone signals for producing a sequence of pulses coincident with the zero crossings of the alternating current tone signals whenever a pulse is supplied by said source of pulses; and control means coupled to said coincidence circuit means and to the control terminal of said variable attenuator means, said control means receiving said sequence of pulses from said coincidence circuit means and in response thereto providing signals to said control terminal of said variable attenuator to change the attenuation thereof in coincidence with said zero crossings, whereby an attenuated tone signal is provided at the signal output terminal of the variable attenuator means.

2. The combination according to claim 1 wherein said variable attenuator initially produces minimum attenuation of input signals applied thereto and increases the attenuation of input signals in response to a predetermined stepped pattern corresponding to the frequency of the pulses in the sequence of pulses produced by said coincidence circuit means.

3. The combination according to claim 1 wherein the duration of each pulse from said source of pulses is long relative to the time interval between successive zero crossings of the alternating current tone signals.

4. A keying system for an electronic musical instrument including in combination:

a source of sine wave tone signals of a predetermined frequency;

variable attenuator means having an input coupled to said source of tone signals, a signal output terminal, and at least one control terminal, the variable attenuator means being adapted to provide an output signal which corresponds to the tone signal attenuated in response to a control signal at the control terminal;

a source of rhythm pulses;

coincidence circuit means coupled to said source of rhythm pulses and to said source of tone signals for producing a sequence of output pulses coincident with the zero crossings of the sine wave tone signals whenever rhythm pulses are supplied by said source of rhythm pulses, said coincidence circuit means including at least a zero crossing detector means and coincidence gate means having first and second inputs and an output, said zero crossing detector means being coupled between the output of said source of tone signals and the first input to said coincidence gate means, and the second input to said coincidence gate means being coupled to said source of rhythm pulses; and control means having an input coupled to the output of said coincidence gate means for receiving said sequence of pulses therefrom and for operating in response thereto, said control means having a control output coupled to the control terminal of said variable attenuator means for controlling the operation thereof to provide the attenuated tone signal at the signal output terminal of the variable attenuator means.

5. The combination according to claim 4 wherein said coincidence gate means comprises a first coincidence gate, a second coincidence gate, each having first and second inputs, and bistable circuit means; said zero crossing detector means is coupled to the first inputs of said first and second coincidence gates; said source of rhythm pulses is coupled to the second input of said first gate; the output of said first coincidence gate is coupled to a "set" input of said bistable circuit means, the output of which is coupled to the second input of said second coincidence gate; and the output of said second coincidence gate is coupled to said control means as the input thereto.

6. The combination according to claim 5 wherein said variable attenuator means has a plurality of control terminals responsive to control signals applied thereto to vary the attenuation of signals applied to the input terminal thereof, and said control means further includes binary counter means having a plurality of outputs coupled with the plurality of control terminals respectively of said variable attenuator means, the outputs of said binary counter means further being coupled with third coincidence gate means having an output coupled to a "reset" input of said bistable circuit means; and the input of said binary counter means is coupled to the output of said second coincidence gate means.

7. The combination according to claim 6 wherein the output of said bistable circuit means is coupled with a "clear" input of said binary counter means to set a predetermined initial count into said binary counter means in response to a predetermined transition in the stable states of said bistable circuit means.

8. The combination according to claim 6 further including frequency divider means coupled between the output of said second coincidence gate and the input of said binary counter means.

9. The combination according to claim 8 wherein said frequency divider means comprises a programmable frequency divider.

* * * * *